350-319 SR
12/27/77 XR 4,064,826

United States Patent [19]
Pauli

[11] 4,064,826
[45] Dec. 27, 1977

[54] REFRIGERANT LIQUID INDICATOR

[75] Inventor: Jude A. Pauli, Florissant, Mo.

[73] Assignee: Emerson Electric Co., St. Louis, Mo.

[21] Appl. No.: 682,194

[22] Filed: May 3, 1976

[51] Int. Cl.[2] ..... F25B 49/00; G02B 7/00
[52] U.S. Cl. ..... 116/117 C; 62/125; 350/319
[58] Field of Search ..... 116/117 C, 117 R; 73/331, 327; 222/159; 62/125; 350/319

[56] References Cited

U.S. PATENT DOCUMENTS

| | | | |
|---|---|---|---|
| 821,872 | 5/1906 | Hodges et al. | 73/327 |
| 2,600,148 | 6/1952 | Wittlin | 62/125 X |
| 2,933,060 | 4/1960 | Yocum | 116/117 R |
| 3,142,287 | 7/1964 | Jones | 62/125 X |
| 3,525,231 | 8/1970 | Armstrong | 62/125 |

OTHER PUBLICATIONS

Publ. "Kimballs College Textbook of Physics", by Waterman, 1954, pp. 739–743, NY Henry Holt & Co., Publishers (Sixth Edition).

*Primary Examiner*—Daniel M. Yasich
*Attorney, Agent, or Firm*—Polster, Polster and Lucchesi

[57] ABSTRACT

A sight glass device for liquid line is provided which clearly demonstrates to an observer the state of the fluid in the line, and which magnifies even small bubbles of gas. The device includes a reflector surface separated from a convex lens by a fluid sight chamber. The optical effect of the lens, fluid and reflective surface is such that full, partially full, and gas bubbles all give distinctive and different visual indications to the observer.

4 Claims, 5 Drawing Figures

REFRIGERANT LIQUID INDICATOR

BACKGROUND OF THE INVENTION

This invention relates to sight glass devices, and in particular, to a sight glass for indicating the state of a fluid in a fluid system having a simplified construction. While the device is described with particular reference to refrigeration systems, those skilled in the art will recognize the wider applicability of the invention disclosed hereinafter.

Sight glasses of various types and constructions are well known in the art. One area where sight glasses find application is in refrigeration systems where the device is inserted in the refrigerant line. The sight glass enables maintenance or operational personnel to observe certain states of the fluid passing through the line. In general, prior art sight devices only permit indication of a full or empty condition of the fluid line. A partially full condition in the fluid line, generally a prelude to the empty condition, is not easily detected.

This invention disclosed hereinafter differs from known prior art sight glass devices in that the visual presentation made to an observer has a distinct presentation for all conditions possible in the system with which the sight glass finds utility. That is, the sight glass of this invention is capable of illustrating a partially full condition in the liquid line as one visual presentation, yet shows a second, distinct visual indication for a completely full liquid line. In addition, the structure highly magnifies any bubbles of gas passing through the fluid system.

One of the objects of this invention is to provide a low-cost sight glass device.

Another object of this invention is to provide a sight glass capable of showing the flow condition in a fluid line.

Another object of this invention is to provide a sight glass which differentiates between a full liquid flow condition and a partial liquid flow condition in a fluid line.

Still another object of this invention is to provide a sight glass for use in a fluid line which magnifies minute bubbles of gas in the fluid passing the sight glass.

Other objects of this invention will be apparent to those skilled in the art in light of the following description and accompanying drawings.

SUMMARY OF THE INVENTION

In accordance with this invention, generally stated, a sight glass is provided including an elongated body part defining a sight glass cavity. One end of the body part is closed by a device having a reflective surface, while the second end of the body part is closed by a convex lens arranged with the exterior curve of the convey shape directed toward the observer. The body includes tube stubs which are utilized to insert the sight glass in a fluid line. The reflective surface, as observed through the lens, changes its diametric size as fluid flow through the fluid line varies from full flow. The lens also magnifies bubbles in the line, making the bubbles easy to observe.

DESCRIPTION OF THE PREFERRED EMBODIMENT

Figure 1:
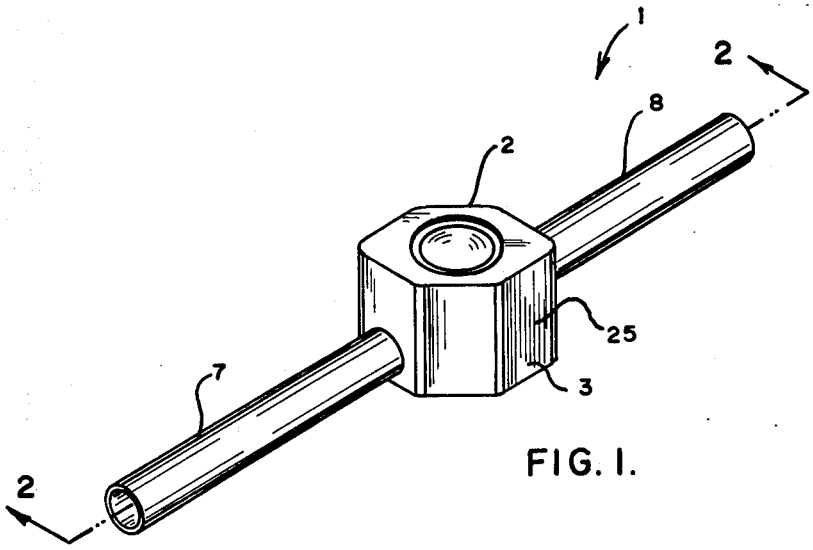
FIG. 1 is a view in perspective of one illustrative embodiment of sight glass of this invention.
Figure 2:
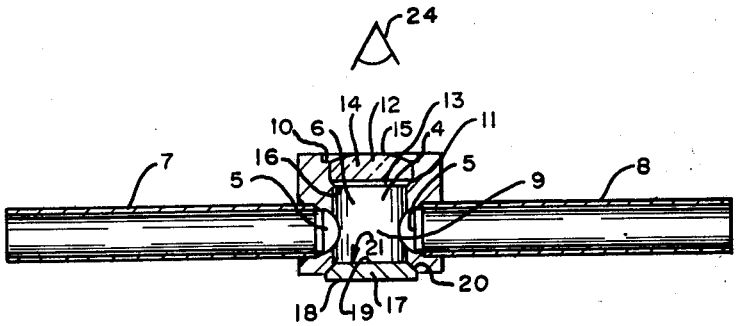
FIG. 2 is a sectional view taken along the line 2—2 of FIG. 1.

Referring now to FIG. 1, reference numeral 1 indicates one illustrative embodiment of sight glass of this invention. The sight glass 1 includes a main body part 2 defined by a tubular section 3. The tubular section 3 has an axial opening 4 through it, which is best seen in FIG. 2. The body part a also has a radial opening 5 through it, the opening 5 communicating with the opening 4 within the tubular section 3. The junction of the openings 4 and 5 defines a sight chamber 6.

In the embodiment illustrated, a pair of tube stubs 7 and 8 are attached to the body part 2 along the radial opening 5. The tube stubs 7 and 8 may be attached to the body part 2 by any convenient method. Brazing, soldering or welding work well, for example. The tube stubs 7 and 8 are used to insert the sight glass 1 in a fluid line at any convenient location. In a refrigeration system, for example, the most likely insertion position for the sight glass 1 is in the refrigerant line upstream of a conventional expansion means commonly utilized in such systems. Those skilled in the art will recognize that a variety of other connection constructions may be employed in place of the tube stubs shown in FIG. 1, for assisting in sight glass 1 installation in a particular application. The more conventional connections include flared ends along the tube stub ends, male and female terminations on the tube stubs, or combinations of flares and male and female terminations.

Body part 2 also may have a variety of design configurations. The particular embodiment illustrated has an outer wall 25 formed in a conventional hexagonal design. Other designs are compatible with the broader aspects of this invention. An inner wall 9 of the body part 2 delimits the opening 4. Opening 4 has a plurality of diameters along its axial length which define both a sight opening 10 and a support ledge 11. A sight lens 12 is mounted between the sight opening 10 and the support ledge 11. Preferably, sight lens 12 has a bevel 13 formed along its axially inward end. The bevel 13 mates with the ledge 11 in the mounted position of the lens 12.

Sight lens 12 is conventional, and includes a body 14 having an upper convex surface 15 and a lower, substantially planar surface 16. The sight lens 12 is attached to the body section 2 by any convenient method. For example, the sight glass may be adhesively or mechanically secured to the body section 2. More demanding applications may require a fusion joint between the body part 2 and the sight lens.

The second end of the axial opening 4 is closed by a cap 17. Cap 17 includes an outer surface 18 and an inner surface 19 having a material thickness therebetween. The cap 17 and the body part 2 may be beveled as indicated at 20 to aid in the attachment of the cap 17 to the body part 2. The surface 19 either is polished or made reflective prior to its attachment with the body part 2. The surface 19 defines a reflecting means 21 for the sight lens 12, the reflecting means 21 being visible through the lens 12 from an observer 24 side of the lens 12.

Figure 3:
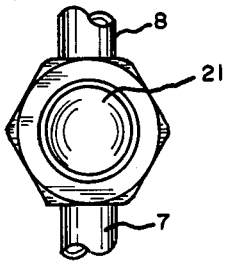
FIG. 3 is a top plan view of the sight glass shown in FIG. 1, diagrammatically illustrating the sight glass condition for full fluid flow.
Figure 4:
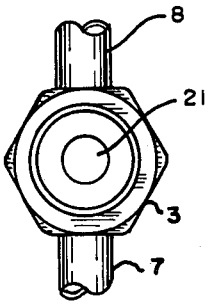
FIG. 4 is a top plan view of the sight glass shown in FIG. 1, diagrammatically illustrating the sight glass condition for partial fluid flow.
Figure 5:
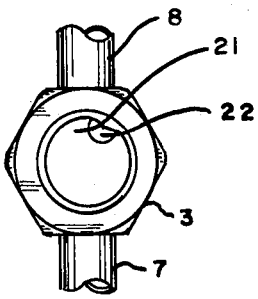
FIG. 5 is a top plan view of the sight glass shown in FIG. 1, diagrammatically illustrating the observance of the reflective device through the sight glass when a bubble is present in the fluid passing the sight glass.

Operation of the device of this invention is relatively simple to understand. The sight glass 1 is inserted in a fluid line at any convenient location. Thereafter, fluid flow through the chamber 6 may be observed by looking through the lens 12. The combination of the lens 12, reflective means 21, and fluid in the chamber 6 combine to provide variable visual representations at the observer 24 side of the sight glass 1. Illustrative examples of these representations are shown in FIGS. 3 through 5. When a fluid completely fills the chamber 6, the reflective means 21 has a large diameter appearance which substantially corresponds to the diameter of the lens 12. The full flow condition is shown in FIG. 3. Under partial fluid flow conditions, that is, when fluid does not fill the sight chamber 6, the reflective means 21 has a reduced diameter appearance, which is substantially less than the diameter of the lens 12. The changeover between the full and partial full conditions in the chamber 6 is instantaneous and dramatic in appearance. FIG. 4 shows the visual indication observable with partial flow. Complete loss of a liquid in the chamber 6 also presents a reduced diameter reflective means 21 indication to the observer, which may be smaller than that represented in FIG. 4. For practical purposes, however, the indication of partial flow in the system is the important consideration, as partial flow generally portends loss of all flow.

FIG. 5 illustrates a condition in which at least one gas bubble 22 is present in the chamber 6. In this condition, bubble 22 appears magnified, and the reflective means 21 has an irregular appearance tending toward the large diameter indication of full flow. However, the appearance of the reflective means 21 depends upon the size and number of bubbles present in the chamber 6. In any event, the visual effect is dramatic and easy to detect by an observer.

Numerous variations, within the scope of the appended claims, will be apparent to those skilled in the art in light of the foregoing description and accompanying drawings. Thus, the design silhouette of the sight glass 1 may vary in other embodiments of this invention. As indicated, a variety of terminations for the stubs 7 and 8 are compatible with the broader aspects of this invention. While particular materials or constructional steps were indicated as preferred, other materials or steps may be utilized, if desired. The cap 17 may be removably mounted to the body part 2, if desired, in order to permit cleaning or other rejuvenation of the reflecting means 21. These variations are merely illustrative.

Having thus described the invention, what is claimed and desired to be secured by Letters Patent is:

1. A sight which indicates the difference between a full fluid condition and any fluid condition less than a full condition, comprising:

a body part having an axial opening and a radial opening extending through it, said axial and radial openings intersecting one another in said body part, the intersection of said openings defining a sight chamber;

a convex lens means mounted to said body part along a first end of said axial opening, said lens means closing the first end of said axial opening, said convex lens having a first curved wall directed outwardly of said axial opening and a generally planar wall directed inwardly of said axial opening, said convex lens magnifying any bubbles present in said sight chamber, the curved wall of said lens extending across said axial opening in an unbroken arc;

a reflective means mounted to said body part along a second end of said axial opening so as to close the second end of said axial opening, said reflective means being observable through said lens means and said sight chamber; and means for connecting said body part to a fluid conduit so that fluid flows through said sight chamber, the amount of fluid in said sight chamber coacting with said lens means and said reflective means to vary the size of said reflective means when viewed through said lens means as a function of the amount of fluid in said sight chamber, a full fluid condition in said sight chamber giving the appearance of an enlarged reflective means as viewed through said lens, and any fluid condition in said sight chamber less than a full condition giving the appearance of a small reflective means as viewed through said lens means.

2. The sight glass of claim 1 further characterized by first and second tube stubs mounted to said body part along opposite ends of said radial opening.

3. The sight glass of claim 2 wherein said reflective means is removably mounted to said body part.

4. A sight glass which indicates the difference between a full fluid condition and any fluid condition less than a full condition, comprising:

a body part, said body part having a first opening and a second opening intersecting one another in said body part, the intersection of said openings defining a sight chamber;

a convex lens mounted to said body part along said first opening on a first side of the intersection of said first and said second openings, said lens closing said first opening, said convex lens having a first curved wall directed outwardly of said first opening, and a generally planar wall directed inwardly of said first opening, said convex lens magnifying any bubbles present in said sight chamber; and closure means mounted to said body part along said first opening on a second side of the intersection of said first and said second openings, said closure means closing said first opening, said closure means having a first wall, said wall having a reflective surface associated with it to reflect light rays through both of said first opening and said lens means, said reflective surface, said lens means and fluid in said sight glass combining to vary the size of said reflective surface as viewed through side lens means between a first, large size when the sight chamber is full with fluid and a second, relatively smaller size when said sight chamber is in any fluid condition that is less than full.

* * * * *

UNITED STATES PATENT AND TRADEMARK OFFICE

CERTIFICATE OF CORRECTION

PATENT NO. : 4,064,826

DATED : December 27, 1977

INVENTOR(S) : Jude A. Pauli

It is certified that error appears in the above-identified patent and that said Letters Patent are hereby corrected as shown below:

Column 1, line 22, "This invention" should be "The invention".

Column 1, line 55, "convey" should be "convex".

Column 2, line 19, "body part a" should be "body part 2".

Column 3, line 12, "these representations" should be "these visual representations".

Column 3, line 56, "A sight which" should be "A sight glass which".

Column 4, line 59, "through side" should be "through said side".

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*